United States Patent [19]

Wortman

[11] 4,115,610

[45] Sep. 19, 1978

[54] QUILT CONSTRUCTION AND METHOD OF MAKING SAME

[76] Inventor: Harold Wortman, 5936 Monroe St., Morton Grove, Ill. 60053

[21] Appl. No.: 719,072

[22] Filed: Aug. 30, 1976

[51] Int. Cl.[2] ..... B32B 3/06; B32B 3/20

[52] U.S. Cl. ..... 428/102; 5/343; 112/420; 156/210; 156/227; 428/166; 428/68; 428/188

[58] Field of Search ..... 428/12, 68, 71–76, 428/102, 119, 120, 124, 125, 130, 166, 188, 181–186, 163, 175, 178, 179; 5/343; 112/117, 262, 420; 2/97; 156/205, 210, 227

[56] References Cited

U.S. PATENT DOCUMENTS

| | | | |
|---|---|---|---|
| 3,192,099 | 6/1965 | Beckman et al. | 428/310 |
| 3,405,674 | 10/1968 | Coates et al. | 428/102 |
| 3,528,875 | 9/1970 | MacDonald et al. | 428/181 |
| 3,544,417 | 12/1970 | Corzine | 428/188 |
| 3,787,906 | 1/1974 | Hunt | 5/343 |
| 3,805,720 | 4/1974 | Hunt | 112/420 |
| 3,857,125 | 12/1974 | Hunt | 5/343 |
| 3,969,563 | 7/1976 | Hollis, Sr. | 428/186 |

*Primary Examiner*—William J. Van Balen
*Attorney, Agent, or Firm*—Alter and Weiss

[57] ABSTRACT

An improved quilt construction and method for making quilted articles, such as sleeping bags, jackets and bedspreads, in which baffles are interposed between the upper and lower quilt surfaces of the article. The baffles themselves are formed from portions of the upper or lower surface itself through various patterns of folding. Pre-notched surface materials further facilitate the formation of the folds and locate the positions for the fold which are restrained in place to form compartments in which quilt filler material is positioned.

12 Claims, 5 Drawing Figures

QUILT CONSTRUCTION AND METHOD OF MAKING SAME

BACKGROUND OF THE INVENTION

The present invention relates in general to quilted articles and, in particular, to a quilt construction and method of making the quilted articles.

Quilted articles, such as sleeping bags, jackets, bedspreads and the like, have, throughout history, been used for the warmth and comfort characteristics which are imparted to a user. While materials might vary, most quilted articles comprise a plurality of quilt encompassing materials and a filler material sandwiched between these encompassing materials which provides increased insulation and comfort. While virtually many materials can be used as quilt encompassing materials, such as cotton, synthetics, plastics, and the like, most quilted articles have filler material made of down, or natural or synthetic bulked fibers.

For the most part, constructions of quilted articles utilize a simple "sandwiching" technique in which the upper and lower surface fabrics are stitched together at regular intervals and filler material is placed between the stitching. This method is often used in summer weight bags and jackets which do not require extensive warmth properties. Obviously, the disadvantages of this type of quilt construction lies in the "coldspots" which are formed at stitching lines at which location the insulation thickness is reduced. For that reason a plain, single sewn-through construction is often not considered appropriate for sleeping bags although it is quite satisfactory for all but substantially cold weather clothing.

Warmer clothing or bags are often made through a construction and method in which baffles are interposed between the surface to enable the insulation to have a consistent thickness throughout the entire quilted article. Instead of reducing the cross-sectional width of the quilting at the points of stitching, small webs are inserted between the sandwiching surface materials to form geometrically shaped compartments of constant thickness. The webs or baffles, as they are often called, extend on the interior of the quilt from the lower surface to the upper surface and are either arranged in a box tube arrangement wherein the compartments are rectangularly shaped, or overlapping tube construction wherein the compartments are triangularly shaped.

In most conventional box tube constructions the webs are independent, individual material strips which are sewn at the top surface and the bottom surface to describe the compartment cavity. In the overlapping tube construction, a third piece of fabric is placed between the upper and lower surface and sewn first to one side and then to the other repetitively to form a series of triangular channels. While a quilted article can be so fabricated and possesses the features of improved insulation and restraint of quilt filler material in place, these two conventional constructions and methods involved therewith do have some drawbacks. These drawbacks include, usually, higher expense and fabricating requirements to work with a third baffling segment or a vast plurality of individual baffle elements. The time and trouble involved with proper location of each one of the baffle members and securement to the upper and lower surfaces is often prohibitive.

It is thus an object of the present invention to provide an alternative construction and method for constructing a quilted article with a minimum of quilt material components.

It is also an object of the present invention to provide a construction and method for constructing a quilted article which facilitates the fabrication of a quilt through novel baffle attachment techniques while leaving the article still comfortable to use with substantial insulating characteristics.

Similarly, it is an object of the present invention to provide a method and construction for quilted article fabrication which more adequately distributes distortion or stress exerted on the quilted article to preserve heat insulating and comfort qualities of the article in a strongly constructed quilt arrangement.

These and other objects of the invention will become apparent in light of the present specification.

SUMMARY OF THE INVENTION

The present invention includes an improved method of fabricating quilted articles such as sleeping bags, jackets, and bedspreads. The steps comprising this improvement in fabrication include positioning the first layer of quilt encompassing material substantially along the first plane. A series of baffling ridges are formed from this layer by repeatedly folding the layer of material at angles to the first plane and doubling back the material until the material returns to the first plane of the quilt encompassing material, at which point it intersects the material. Each of the successive intersections is restrained respectively by fastening the intersections at the first plane to form channel spaces between the baffling ridges while securely positioning and shaping the baffling ridges. Channel spaces thereby formed between the baffling ridges are then encompassed similarly with quilt encompassing material to form fully enclosed channel compartments with are then filled with quilt filler material means.

The preferred embodiment of the improved method includes the step of sealing the open ends of the filled channel compartment, thereby securing the positioning of the compartment, as well as the filler material positioned therebetween.

In one embodiment of the method, the single layer of quilt material is repeatedly folded to extend along a second plane which is substantially parallel to the first plane after forming each of the baffling ridges respectively. The folds in the layer of quilt encompassing material are then aligned so that the first end of each baffling ridge intersects with the quilt encompassing material in the first plane and the second end of each said baffling ridge intersects with the quilt encompassing material in said second plane. In the same manner that the intersections of the first plane are securely fastened, so are the intersections of each of the respective second ends of each baffling ridge securely fastened at the intersection of each with the portion of quilt encompassing material in the second plane.

In yet another embodiment of the present method, a second layer of quilt encompassing material is utilized to encompass the channel spaces between the formed baffling ridges. This second layer of material forms a second plane substantially parallel to the first plane over the outer exposed ends of the baffling ridges so as to intersect the series of baffling ridges. This second layer of material which forms a plane substantially parallel to the first plane, is then securely fastened at each of the repective intersections with the baffling ridges so as to describe a series of tubular channel compartments enclosed on two sides by successive baffling ridges and formed on the other two sides by the portions of the first and second layers of quilt encompassing material.

In both of the two embodiments of the method shown, an additional step is utilized for the preferred embodiment which includes the step of pre-forming a series of folding notches into the first layer of quilt encompassing material to thereby facilitate the formation of folds at desired locations in the first layer, as well as to facilitate fastening at the inner sections of these folds. This pre-forming process may also be utilized towards a preferred embodiment of the process in which two distinct quilt encompassing layers are used, wherein the second layer of quilt encompassing material has pre-formed intersection notches fabricated to facilitate the positioning of this second layer over the series of baffling ridges to locate the intersection, as well as to facilitate the fastening at the intersections of the series of ridges to the second layer of material. In both the first and second embodiments through which fastening is performed, such fastening may be accomplished through stitching and sewing the intersections together, or, may be accomplished through the use of heat with thermo-reactive material.

The present invention further includes an improved quilt construction for quilted articles, such as sleeping bags, jackets, and bedspreads, having one or more layers of quilt encompassing material means forming a top and a bottom lining surface of the quilted article. A plurality of baffling ridges are interposed between the top and bottom surfaces of the quilt encompassing material means and the baffling ridges therein interposed, comprise folded portions of the quilt encompassing material means themselves. The folded portions emanate at an angle from the bottom surface of the material to the top surface and successively from the top surface to the bottom surface, to form a series of intersections with the top and bottom surfaces respectively to thereby create a series of quilt compartments. Further, the baffling ridges are securely restrained between the top and bottom surfaces at each of these respective intersections by baffle fastening means. Similarly, quilt filler means are placed within the quilt compartment towards fabrication of the overall quilted article.

One preferred embodiment of the invention utilizes quilt encompassing means which comprise a single layer of quilt encompassing material. The bottom surface of this quilt encompassing material comprises a plurality of portions of this single layer of material, extending laterally in a first plane. Each of the baffling ridges comprises a portion of this single layer of material repeatedly folded at a first end at an angle to this first plane and extends a desired amount to its second end. Of course, it should be realized that the desired amount of extension imparted to the baffling ridge determines the overall width of the quilted article. The top surface of the quilt encompassing material comprises a plurality of portions of the same single layer of material emanating at each of the second ends of each respective baffling ridge, and extending laterally in a second plane substantially parallel to the first plane. Each of the first ends of the baffling ridge are attached successively at their folds to the proximate first end of an adjoining baffling ridge by baffle fastening means. Similarly, each of the second ends of each said baffling ridge is attached successively to the proximate end of an adjoining ridge by equivalent baffle fastening means.

The resultant article thus comprises a single layer of material which has successively formed a series of quilt compartments without the need for insertion of independent quilt baffling.

In yet another embodiment of the invention, the quilt encompassing means comprises two or more layers of quilt encompassing material. The first of these two or more layers of material, comprises a first surface and portions of the second or more, of the two or more layers of material, comprises a second surface. Each of the baffling ridges comprises a portion of the second layer folded toward the first layer of material and doubled back toward the second layer of material after intersection of an end of each of said ridges with the first layer of material. In a similar fashion to the embodiment previously mentioned, each of the ends of each said ridge which intersects with the first layer of material respectively, is attached along the first layer of material by baffle attachment means. Thus, in such a construction, the two or more layers of material thereby form a series of quilt compartments without the need for insertion of independent quilt baffles.

In the preferred embodiments of the previously mentioned versions of the quilted article construction, the one or more layers of quilt encompassing material means have pre-formed folding notches to facilitate the formation of folds at desired locations along the material means and to facilitate the restraint of the baffling ridges between the top and bottom surfaces at each of the said intersections.

Similarly, while any one of a number of equivalent baffle fastening means may be used, the preferred embodiment of the invention utilizes sewn stitches to anchor the baffling ridges at respective intersections with the top and bottom surfaces.

DETAILED DESCRIPTION OF THE DRAWINGS

Figure 1:
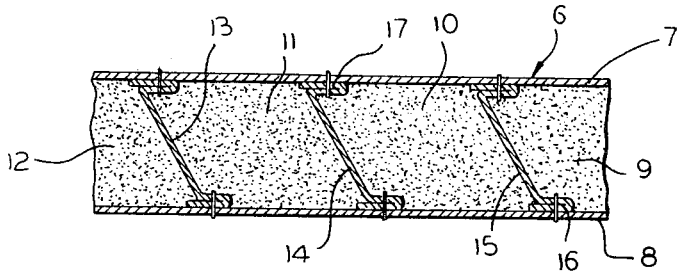
FIG.1 PRIOR ART
FIG. 1 of the drawings is a side cross-sectional view of the prior art which, in particular, illustrates the utilization of independent baffling means within a quilted article.

While this invention is susceptible of embodiment in many different forms, there is shown in the drawings and will herein be described in detail, several specific embodiments, with the understanding that the present disclosure is to be considered an examplification of the principles of the invention and is not intended to limit the invention to the embodiments illustrated.

FIG. 1 of the drawings illustrates the cross-sectional construction of prior art quilted articles. In this illustration, quilted article 6 is shown constructed of two layers of quilt encompassing material 7 and 8, with layer 7 providing the upper surface and layer 8 providing the lower surface for the article's construction. In order to eliminate cold spots in the article construction, as well as to restrain the quilt filler material into designated channels, a series of baffles, such as baffles 13, 14 and 15 are interposed between the upper and lower surfaces 7 and 8 respectively. The conventional quilted article utilizes independent baffle inserts 13, 14 and 15 of independent baffling segments which could be of the same material used for the upper and lower surfaces 7 and 8 respectively. Attachment of these baffles, such as baffle attachment 17, and baffle attachment 16, is accomplished through conventional fastening means, such as sewing and stitching. Once the baffles are placed in position and fastened between the upper and lower surfaces 7 and 8, it can be seen that a series of quilted article channel compartments, such as compartments 9, 10, 11 and 12 are formed therein, into which quilting filler material may be inserted. Thus, it should be realized that in the conventional construction, two or more layers of quilt encompassing material are used for the upper and lower surfaces and a plurality of separate baffled segments are interposed between these surfaces to obtain the quilted construction.

The main feature of the present invention and the method for making such a quilted article, is the dependence upon on one layer of quilt encompassing material to provide not only one or both of the article surfaces, but also to form the actual baffling ridges interposed between these upper and lower surfaces.

Figure 2:
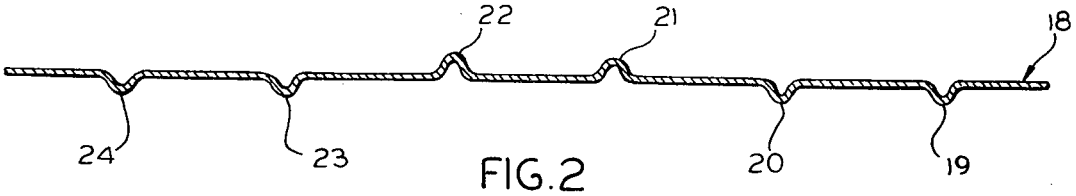
FIG. 2 of the drawings is a side cross-sectional view of pre-notched quilt encompassing material means.

In FIG. 2 the joints, for example, there is shown a pre-notched layer of quilt encompassing material 18, having notches 19 through 24 therein fabricated to facilitate formation of baffle segments and attachment of these segments in a secure manner between the upper and lower surfaces of the quilted article. In the particular construction shown in FIG. 2, quilt encompassing material 18 has fabricated therein downward notches 19, 20, 23 and 24, as well as upward notches 21 and 22, to form a particular configuration of the present invention in a facilitated manner. It should be realized that quilt encompassing material 18, or, for that matter, virtually any embodiments of the present invention and method, can be of any one of a number of conventionally available quilt encompassing material fabrics, such as cotton, synthetics, knits, or other equivalent fabrics.

Figure 3:
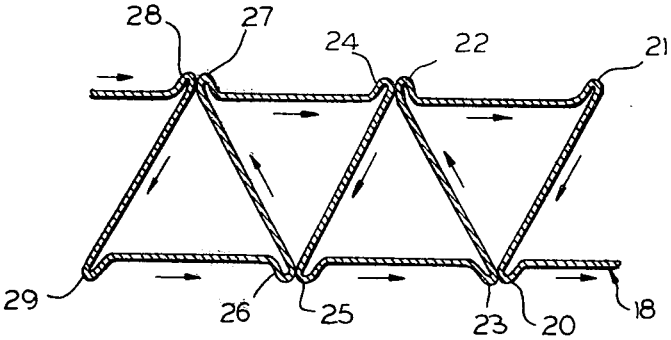
FIG. 3 of the drawings is a side cross-sectional view of quilt encompassing means, such as that shown in FIG. 2, positioned so as to form quilt channel compartments for the insertion of quilt filler material.

Whether the pre-notched quilt encompassing material layer 18 of FIG. 2 is utilized or a non pre-notched quilt encompassing material layer is used, the article construction and method for making the article, as shown by FIG. 3 is obtainable. As can be seen in FIG. 3, through the use of arrows, the notches or folds occurring at fold 20 through 29 are arranged in this particular embodiment of the invention to enable fabrication of the article through one single layer of quilt encompassing material. As can be seen to the left of fold 28, a portion of the material proceeds laterally in one plane at which point it is folded at fold 28, downwardly toward fold 29, again laterally in a plane substantially parallel to the first plane, upwardly at fold 26, laterally at fold 27, downwardly at fold 24, laterally at fold 25, and so on.

To impart a channel compartment configuration to the single layer of quilt encompassing material, successive folds in each of the respective planes are drawn up to one another for subsequent attachment by baffle fastening means, as well as insertion of the quilt filler material.

Figure 4:
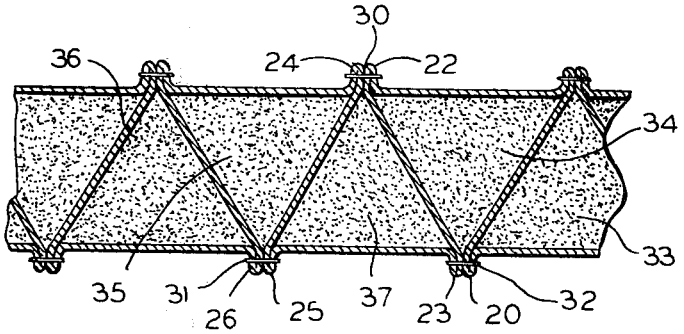
FIG. 4 is a cross-sectional side view equivalent to that shown in FIG. 3, in which the quilt encompassing material means have been secured by baffle fastening means, both at its upper and lower surfaces to securely describe channel compartments which are shown with filler material inserted.

The completed article construction as disclosed in FIG. 3 of the drawings, is shown in FIG. 4 wherein folds 20 through 26 correspond to equivalently numbered folds of FIG. 3. As can be seen, fold 20 abuts fold 23 in the same fashion that fold 22 abuts fold 24, fold 25 abuts fold 26, etc., to form channel compartments 33 through 37, which have, in FIG. 4, been shown filled with quilt filler material. In this particular illustration, the folds have been secured by baffle fastening means, such as fastening means 32 between folds 20 and 23, fastening means 30 between folds 22 and 24, and fastening means 31 between folds 25 and 26. The result of such a construction is a multi-compartment configuration for the quilted article which has been formed by a single continuous layer of quilt encompassing material.

While many forms of fastening means may be used, the preferred embodiment characterized in the drawings is that of sewn stitching. Additionally, the extreme ends of the fabricated quilted article could be sealed by stitching around its periphery to close off the otherwise open access to the quilt channels and compartments, towards providing a strong quilted article with excellent insulating properties.

Figure 5:
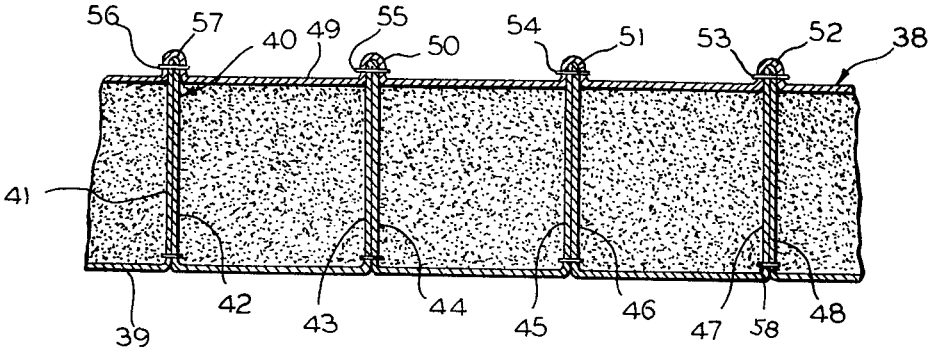
FIG. 5 is a side cross-sectional view of a second embodiment of the invention utilizing two layers of quilt encompassing material with baffles extending therebetween to form a quilted article.

Another embodiment of the invention is shown in FIG. 5 in which a layer of material provides one surface on either top or bottom for the article while, at the same time, providing means from which the baffling ridges can be formed. In FIG. 5 quilted article 38 is shown having a first layer of quilt encompassing material 49 proximately positioned over the vertically extending baffling ridges, such as baffling ridge 40. Another quilt encompassing layer of material 39, is shown to provide the bottom surface of the article's construction. Additionally, it can be seen that material layer 39 folds upwardly at ridge portions 41 and downwardly again at ridge portion 42. After progressing laterally, again the bottom surface material is folded up at 43, down at 44, across and up to 45, down at 46 and so on. The emerging baffling ridges are secured at their points of emanation from bottom surface material layer 39 by baffle fastening means, such as baffle fastening means 58. Further, first material layer means 49 is secured at the other ends of the baffling ridges by equivalent baffle fastening means, such as baffle fastening means 53 through 56. In the same manner that quilt encompassing material 18 can be pre-notched with folds already fabricated therein, layer 49 may also be pre-notched with folds, such as pre-notched folds 50, 51, 52 and 57. However, whether pre-folded or not, the preferred embodiment of the invention incorporates the distribution of first material layer 49 over the tops of each respective baffling ridge for securement thereto by baffle fastening means. In such a manner, a series of compartments is constructed without the means for inserting individual baffling elements.

The foregoing description and drawings merely explain and illustrate the invention and the invention is not limited thereto, except insofar as the appended claims are so limited, as those skilled in the art who have the disclosure before them will be able to make modification and variation therein without department from the scope of the invention.

What is claimed is:

1. An improved method for fabricating quilted articles, such as sleeping bags, jackets and bedspreads comprising the steps of:

positioning a first layer of quilt encompassing material substantially along a first lower plane;

forming a series of baffling ridges from said layer by repeatedly folding said layer of material at substantially acute angles from said first plane and doubling back said material at said substantially acute angles until said material forms a second layer of quilt encompassing material in a second upper plane substantially parallel to said first layer and returns to and intersects said first plane of said quilt encompassing material;

successively aligning said folds in said layers of quilt encompassing material so that a first end of each said baffling ridge intersects with said quilt encompassing material in said first plane and a second end of each said baffling ridge intersects with said quilt encompassing material in said second plane;

restraining the successive intersections in both said first and second planes respectively by pinching and fastening said intersections below said first plane and above said second plane to form channel spaces between said baffling ridges, thereby securely positioning and shaping said baffling ridges so as to form fully enclosed channel compartments; and filling said channel compartments with quilt filler material means.

2. The method according to claim 1 in which the method further comprises the step of sealing the open ends of said filled channel compartments thereby securing the positioning of said compartments, as well as said filler material means positioned therebetween.

3. The method according to claim 1 in which said method includes the step of pre-forming folding notches into said first layer of quilt encompassing material to facilitate the formation of folds at desired locations in said first layer, as well as to facilitate fastening at said intersections.

4. The invention according to claim 1 in which fastening is accomplished through stitching and sewing.

5. An improved quilt construction for quilted articles such as sleeping bags, jackets and bedspreads comprising:

one or more layers of quilt encompassing material means forming a top and a bottom lining surface of said quilted article;

a plurality of baffling ridges interposed between said top and bottom surfaces of quilt encompassing material means;

said baffling ridges emanating at an angle from said bottom surface to said top surface and successively from said top surface to said bottom surface and intersecting with said top and bottom surfaces respectively at a plurality of intersections, to form a series of quilt compartments, said baffling ridges securely restrained between said top and bottom surfaces at each said intersection respectively by baffle fastening means;

said intersections in said top surface pinched and securely restrained on the upper side of said top surface; and quilt filler means inserted into said quilt compartments.

6. The invention according to claim 5 in which said quilt encompassing means comprises a single layer of quilt encompassing material, said bottom surface comprising a plurality of portions of said single layer of material extending laterally in a first plane, each said baffling ridges comprising a portion of said single layer of material repeatedly folded at a first end at an acute angle to said first plane and extending a desired amount to its second end;

said top surface comprising a plurality of portions of said single layer of material emanating at an acute angle at each said second end of each said baffling ridge and extending in a second plane substantially parallel to said first plane, each said first end of each said baffling ridge attached successively to the proximate first end of an adjoining baffling ridge by said baffle fastening means at a position on the lower side of said bottom surface, each said second end of each said baffling ridge attached successively to the proximate second end of an adjoining baffling ridge by said baffle fastening means on said upper side of said top surface, said single layer of material thereby forming said series of quilt compartments without the need for insertion of independent quilt baffles.

7. The invention according to claim 5 in which said quilt encompassing means comprises two or more layers of quilt encompassing material, a first of said two or more layers of material comprising a first surface;

portions of a second or more of the two or more layers of material comprising a second surface, each of said baffling ridges comprising portions of said second layer folded toward said first layer of material and doubled back juxtaposed along said folded portion towards said second layer of material after intersection of an end of each of said ridge with said first layer of material, each said end of each said ridge intersecting with said first layer of material respectively attached along said first layer of material by baffle fastening means; and, said two or more layers of material thereby forming said series of quilt compartments without the need for insertion of independent quilt baffles.

8. The invention according to claim 5 in which said one or more layers of quilt encompassing material means have pre-formed folding notches to facilitate the formation of folds at desired locations along said material means and to facilitate restraint of said baffling ridges between said top and bottom surfaces at each said intersection.

9. The invention according to claim 5 in which said baffle fastening means comprise sewn stitches.

10. An improved method for fabricating quilted articles, such as sleeping bags, jackets and bedspreads comprising the steps of:

positioning a first layer of quilt encompassing material substantially along a first plane;

forming a series of baffling ridges from said layer by repeatedly folding said layer of material at an angle substantially perpendicular to said first plane and doubling back said material along each respective fold of material until said material returns to and intersects said first plane of said quilt encompassing material;

restraining the successive intersections respectively by fastening said intersections at said first plane to form channel spaces between said baffling ridges, thereby securely positioning and shaping said baffling ridges;

positioning a second layer of quilt encompassing material to form a second plane substantially parallel to said first plane, over the outer exposed ends of said baffling ridges so as to intersect said series of baffling ridges with said second layer of quilt encompassing material;

securely fastening said intersections of said baffling ridges to said second layer of quilt encompassing material into gatherings atop said second layer; and filling said channel compartments with quilt filler material means.

11. The method according to claim 10 in which said method includes the steps of pre-forming folding notches into said first layer of quilt encompassing material to facilitate the formation of folds at desired locations in said first layer, as well as to facilitate fastening at said intersections.

12. The method according to claim 10 in which said method includes the step of pre-forming intersection notches into said second layer of quilt encompassing material to facilitate the positioning of said second layer over said series of baffling ridges, as well as to facilitate fastening at said intersections of said ridges and said second layer of material.

* * * * *